United States Patent [19]

Onofri

[11] Patent Number: 4,938,164

[45] Date of Patent: Jul. 3, 1990

[54] SELF-PROPELLED MANNED SUBMERSIBLE VEHICLES FOR UNDER-SEA EXCURSIONS

[76] Inventor: Jean-Michel Onofri, 6, rue Berthelot, 13880 Velaux, France

[21] Appl. No.: 276,861

[22] Filed: Nov. 28, 1988

[30] Foreign Application Priority Data

Dec. 18, 1987 [FR] France ..... 87 17973

[51] Int. Cl.[5] ..... B63G 8/16; B63G 8/24

[52] U.S. Cl. ..... 114/312; 114/338; 114/331; 114/333

[58] Field of Search ..... 114/312, 315, 321, 330–333, 114/337, 338, 66; 405/185

[56] References Cited

U.S. PATENT DOCUMENTS

| | | | |
|---|---|---|---|
| 934,322 | 9/1909 | King | 405/185 X |
| 2,425,846 | 8/1947 | Trewren | 114/178 |
| 3,388,683 | 6/1968 | Barhite et al. | 114/330 |
| 3,390,640 | 7/1968 | Couttet | 104/71 |
| 3,521,589 | 7/1970 | Kemp | 114/338 X |
| 3,527,184 | 9/1970 | McCarty et al. | 114/331 |
| 3,598,074 | 8/1971 | Schubert | 114/16 |
| 3,800,722 | 4/1974 | Lepage | 114/333 |
| 4,809,630 | 3/1989 | Walker | 114/66 |

FOREIGN PATENT DOCUMENTS

| | | |
|---|---|---|
| 1354802 | 9/1962 | France . |
| 2149018 | 2/1973 | France . |
| 2541229 | 2/1983 | France . |

*Primary Examiner*—Sherman D. Basinger
*Attorney, Agent, or Firm*—Ladas & Parry

[57] ABSTRACT

A self-propelled manned submersible vehicle of the type comprising a pressure-resistant capsule (1) serving as a cabin, ballast tanks (3, 8), releasable ballast (7), propulsion units (4) having propellers driven by electric motors, and storage batteries (42), the pressure-resistant capsule (1) comprises a peripheral window constituted by a vertical cylindrical sleeve (19) which is entirely transparent, the sleeve is of sufficient diameter to house a plurality of people sitting side-by-side, and extends upwardly from a hemispherical bottom (14) and downwardly from a spherical cap (16) which is extended by a cylindrical conning tower (21) which is closed by a hatch (22).

10 Claims, 5 Drawing Sheets

3
4
7
8

SELF-PROPELLED MANNED SUBMERSIBLE VEHICLES FOR UNDER-SEA EXCURSIONS

The present invention relates to self-propelled submersible vehicles for going on under-sea excursions.

The technical field of the invention is that of constructing self-propelled submersible vehicles for use in observing the sea bottom.

BACKGROUND OF THE INVENTION

Submersible or semi-submersible vehicles are known for taking a group of tourists on an outing underwater.

These vehicles include transparent portholes through which the sea bottom and marine fauna can be observed.

Submersible pleasure vehicles known heretofore have not been capable of reaching great depths and are not individual vehicles allowing free choice of itinerary.

The object of the present invention is to provide submersible vehicles enabling one or a few people to move freely beneath the water down to depths of about 50 meters having all round view in a horizontal plane and having an angle of vision in a vertical plane which is close to 180°.

SUMMARY OF THE INVENTION

The present invention provides a self-propelled manned submersible vehicle of the type comprising a pressure-resistant capsule serving as a cabin, ballast tanks, releasable ballast, propulsion units having propellers driven by electric motors, and storage batteries, wherein said pressure-resistant capsule comprises a peripheral window constituted by a vertical cylindrical sleeve which is entirely transparent, said sleeve being of sufficient diameter to house a plurality of people sitting side-by-side, said sleeve being extended downwardly by a hemispherical bottom and upwardly by a spherical cap which is extended by a cylindrical conning tower which is closed by a hatch.

Said conning tower preferably includes a second peripheral window constituted by a second vertical cylindrical sleeve which is entirely transparent, and said hatch includes a central transparent porthole.

In a preferred embodiment, the, or each, peripheral window is constituted by a one-piece sleeve of polymethylmethacrylate with the two ends of the sleeve being pressed against gaskets and received in respective channel section flanges, with said flanges being clamped against said sleeve by tie rods.

A vehicle in accordance with the invention may include a tubular frame surrounding said pressure-resistant capsule and supporting all of the other components of the vehicle, with said pressure-resistant capsule being connected to said tubular frame via resilient connections.

Advantageously, said releasable ballast is constituted by a tiltable case filled with material in the divided state, said case being tiltable about a transverse axis supported by said tubular frame, and said vehicle includes means for controlling the pivoting of said case about said axis from inside the pressure-resistant capsule.

The invention provides novel submersible vehicles capable of housing one or a few people and enabling them to move about freely beneath the water in order to visit the sea bottom down to depths of as much as 50 meters.

A submersible vehicle in accordance with the invention provides very good visibility with a field of view of 360° in a horizontal plane and up to 180° in a vertical plane by virtue of the way in which vehicle attitude can be varied by the tiltable ballast.

The operations required for causing a vehicle in accordance with the invention to submerge are relatively simple. Initially the four top ballast tanks are filled by opening the vents.

Even when these ballast tanks are full, buoyancy remains positive.

The occupants then progressively fill the adjustment tank until buoyancy becomes substantially zero.

They can then cause the vehicle to move down through the water by using its propulsion units.

The particular structure of a vehicle in accordance with the invention which includes a pressure-resistant capsule connected by resilient links to a tubular frame which carries all the other components of the vehicle and which withstands the vertical loads in a downwards or an upwards direction presents the advantage of the pressure-resistant capsule being designed independently solely for the need to withstand hydrostatic pressure, thereby making it possible to design a capsule including a transparent cylindrical window capable of being taken down to depths of as much as 50 meters.

Vehicles in accordance with the invention are particularly suitable for leisure centers or holiday clubs situated at the seaside or on a lagoon in order to allow customers to learn how to drive a small submarine and then go on two-person outings underwater to visit the sea bottom.

BRIEF DESCRIPTION OF THE DRAWINGS

An embodiment of the invention is described by way of example with reference to the accompanying drawings, in which:

FIG. 8 is a front half view and a front axial cross-section of the releasable ballast;

FIG. 9 is an axial longitudinal section on IX—IX of FIG. 8; and

MORE DETAILED DESCRIPTION

Figure 1:
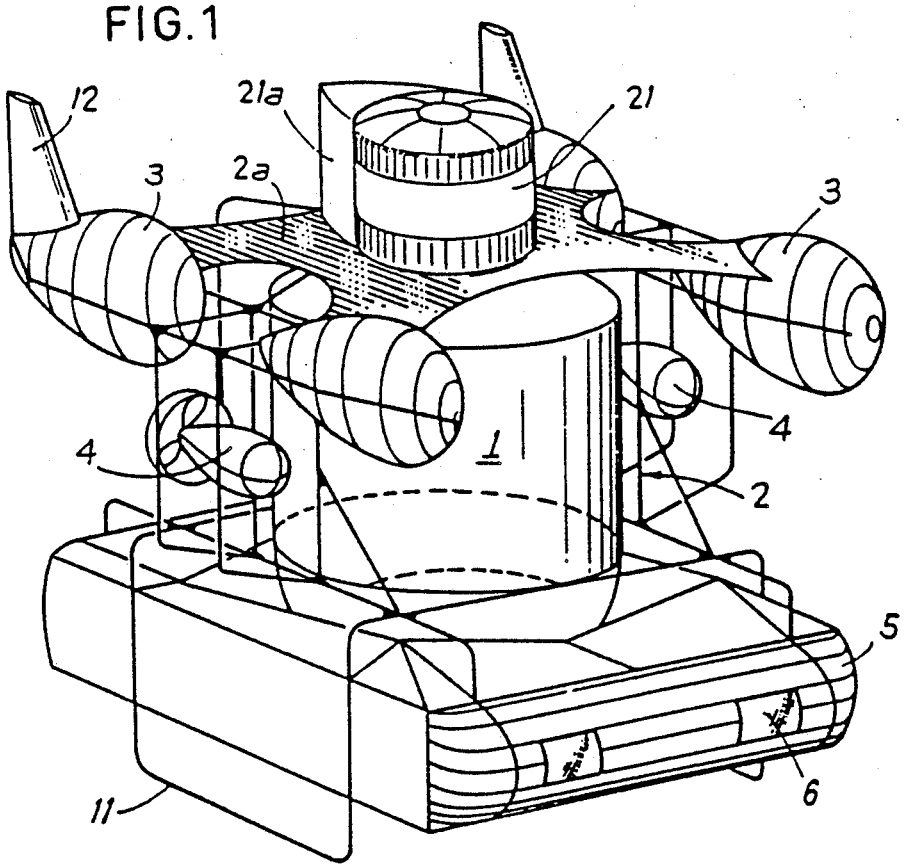
FIG. 1 is a perspective view of a vehicle in accordance with the invention.
Figure 2:
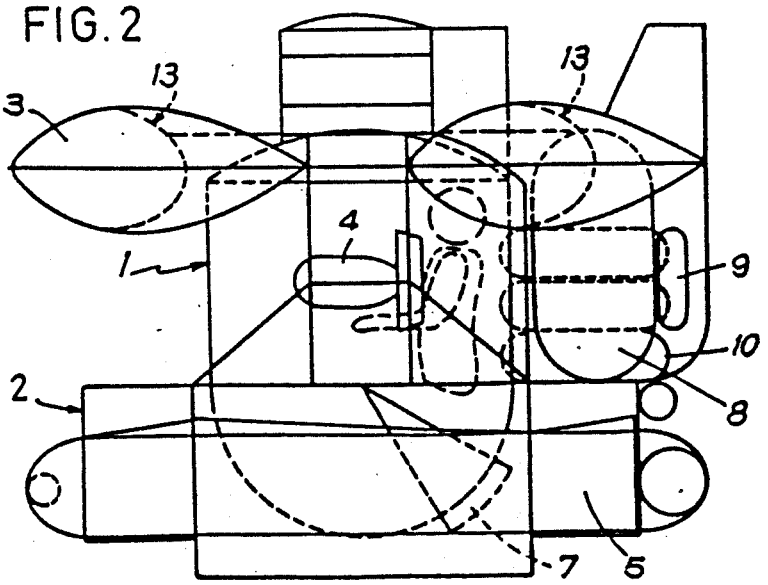
FIGS. 2, 3, and 4 are respectively an elevation view, a half-plan view together with a half horizontal section, and a half-front view together with a half-rear view of a vehicle in accordance with the invention.
Figure 3:
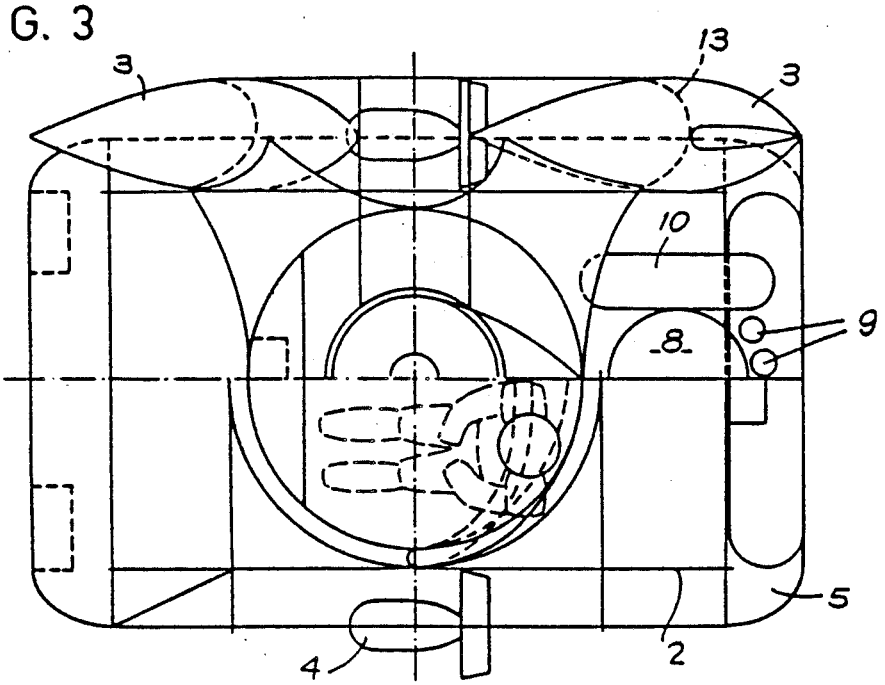

FIG. 1 is a perspective view of a submarine vehicle in accordance with the invention which is shown in elevation in FIG. 2 and in plan view and in horizontal half section in FIG. 3.

Figure 4:
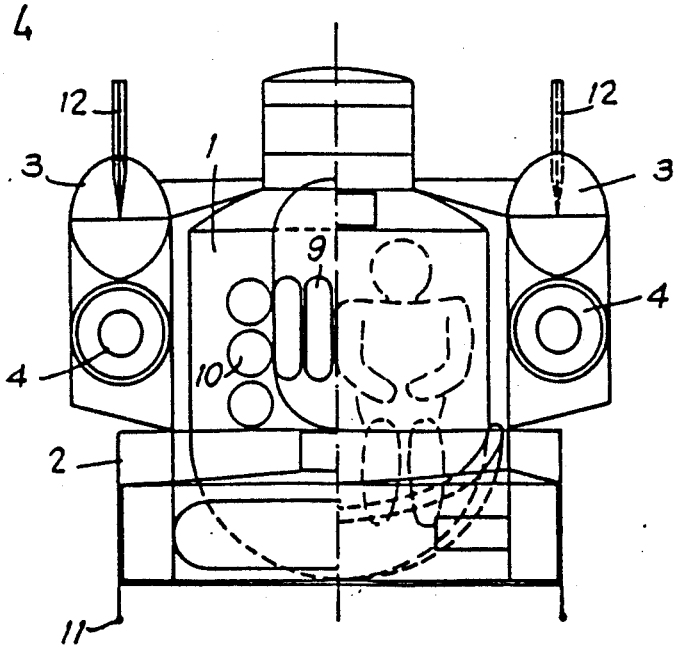

The righthand side of FIG. 4 is a front half view of the vehicle, and the lefthand side of the figure is a rear half view.

A vehicle in accordance with the invention has a capsule 1 in the middle thereof which withstands hydrostatic pressure down to a given depth of immersion, which may be as much as 50 meters, for example.

The capsule 1 is a hollow body serving as a cabin for a few people, for example two people sitting side-by-side.

The vehicle includes a tubular frame 2 which surrounds the central capsule and which is connected thereto be resilient links which are described below.

The tubular frame carries four ballast tanks 3 which are fixed to the top of the frame at a level such that they are largely out of the water when empty and then serve as floats. These ballast tanks are in permanent communication with the sea. The tubular frame also carries two propeller propulsion units 4 situated on either side of the pressure-resistant capsule.

The bottom portion of the tubular frame 2 carries a case 5 which is filled with oil and which contains the batteries that power the motors of the propulsion units. The case 5 also carries headlights 6.

The tubular frame 2 also carries a releasable ballast 7 pivotally mounted about a transverse axis.

The tubular frame 2 also carries an adjustable ballast tank 8 constituted by a cylindrical tank having rounded ends and situated behind the pressure-resistant capsule for the purpose of adjusting the buoyancy of the vehicle during a dive.

Finally, the tubular frame carries cylinders 9 of compressed oxygen for breathing by the occupants of the cabin and cylinders 10 of compressed air for expelling water from the ballast tanks.

It can be seen in FIGS. 1, 2, and 4 that the tubular frame 2 includes two skids 11 which rest on the ground both when the vehicle is ashore and when it is on the sea bottom.

Two rudders 12 are placed at the stern of the two stern ballast tanks and are operable from inside the cabin.

The tubular frame carries a platform 2*a* which surrounds a conning tower 21 which is extended towards the sterm by a fairing 21*a*.

The tubular frame 2 comprises a framework of vertical tubes which are interconnected by horizontal spacers extending longitudinally and transversely and reinforced by sloping tubular bracing. It is designed to operate both in compression when the vehicle is out of the water and in tension when the vehicle is submerged.

It can be seen in FIGS. 1, 2, and 3 that the ballast tanks 3 are pod-shaped and are symmetrical about a horizontal plane and about a longitudinal vertical plane.

Each ballast tank may contain about 100 liters of water. The streamlined shapes of the ballast tanks are intended to reduce drag.

It can be seen in FIG. 2 that the section of each ballast tank on a longitudinal vertical plane is rounded at the forward end and tapering at its after end.

It can also be seen in FIG. 3 that the section of each of the ballast tanks in a longitudinal horizontal plane is pointed at the forward end and rounded at its after end. Dashed line 13 in FIGS. 2 and 3 represents the midships section i.e. the line passing through the points of greatest width. It can be seen that this line is not contained in a plane perpendicular to the axis.

The special shape of the ballast tanks described above is designed to provide a compromise between resistance to forwards movement on the surface and when diving.

It can also be seen in FIGS. 1 to 3 that the motors of the propulsion units are in fairings, i.e. they are located inside streamlined shells which are rounded at the forward end in order to reduce drag.

The propulsion units 4 are pivotally mounted relative to a transverse horizontal axis so as to enable them to be used for propelling the vehicle in any direction. The pivot axis of the propulsion units passes through the center of buoyancy of the capsule.

The propulsion units 4 can be oriented through ± 90° about their pivot axis.

Figure 5:
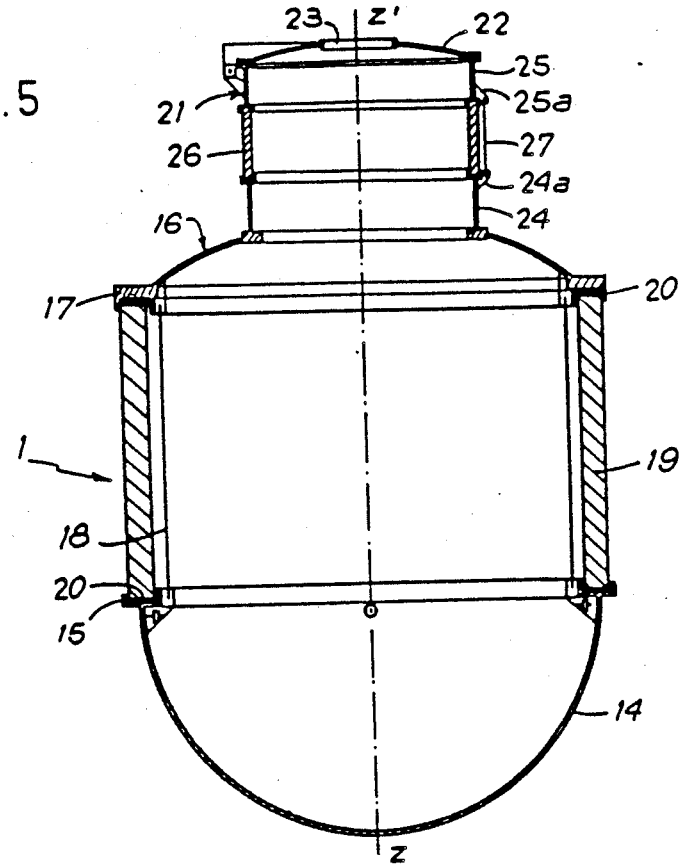
FIG. 5 is an axial section through the pressure-resistant capsule.

FIG. 5 is an axial section through a preferred embodiment of a cabin 1 having room for two seated people. This cabin is a watertight capsule capable of withstanding immersion down to a given depth with an appropriate safety margin, e.g. capable of withstanding hydrostatic pressure down to a depth of 50 meters.

The capsule 1 comprises a bottom 14 made of steel or any other metal in the form of a hemispherical shell which is welded to a flange 15 occupying its diametral plane. The flange 15 may be constituted, for example, by a channel section bar having its own flanges extending upwardly.

The capsule 1 includes a metal top part 16 in the form of a dished cap which is welded to a second flange 17 likewise constituted by a channel section bar but this time having the flanges of the channel section directed downwardly. The two flanges 15 and 17 have the same diameter and they are coaxial. They are interconnected by conventional type draw bars 18 that are connected to flanges 15 and 17.

The pressure-resistant capsule also includes a cylindrical window 19 which is a thick transparent sleeve preferably made of polymethylmethacrylate or of any other transparent material having equivalent mechanical and optical properties. The window 19 is made as a single piece in order to obtain good mechanical strength for withstanding pressure.

The window 19 allows the occupants of the capsule to have a field of view of about 360° in a horizontal plane and about 70° in a vertical plane when the axis z–z′ of the vehicle is vertical.

It is explained below that the pivoting ballast enables the axis of the vehicle to be tilted through ±30° in a longitudinal plane, thereby increasing the field of view so as to enable the occupants to look at the bottom or at the surface vertically below or above the vehicle.

Sealing gaskets 20 are interposed respectively between the bottom edge of the window 19 and the bottom flange 15, and between the top edge of the window 19 and the top flange 17. The thickness of the window 19 is less than the inside width of the flanges 15 and 17 so as to enable it to be received therein.

The cap 16 is extended upwardly by a cylindrical conning tower 21 which is coaxial with the cylindrical window but of smaller diameter.

The conning tower 21 provides a passage for the occupants. It is closed by a sealed hatch 22 in the form of a spherical cap which is reinforced around its periphery by a flange. Sealing is provided by an O-ring which is compressed by three fastening devices each including an excentric system.

The hatch can be operated from inside or outside. It includes a central porthole 23 for observation in a vertical direction.

The cylindrical conning tower 21 comprises a bottom metal cylinder 24 and a top metal cylinder 25, said cylinders being coaxial and having the same diameter and each of them having a flange 24*a* or 25*a*. The conning tower also includes a transparent cylindrical window 26 which is likewise a sleeve of polymethylmethacrylate and which is received in the flanges 24a and 25a which are channel section bars and which have sealing gaskets interposed therein.

The two flanges 24a and 25a are interconnected by conventional external tie rods 27 that are connected to flanges 24a and 25a.

The cylindrical window 26 is out of the water when the vehicle moves on the surface.

By way of non-limiting example, a cylindrical window 19 having a radius of 600 mm, a height of 800 mm, and a thickness of 600 mm makes it possible to dive to a depth of 50 meters with an adequate safety margin.

Figure 6:
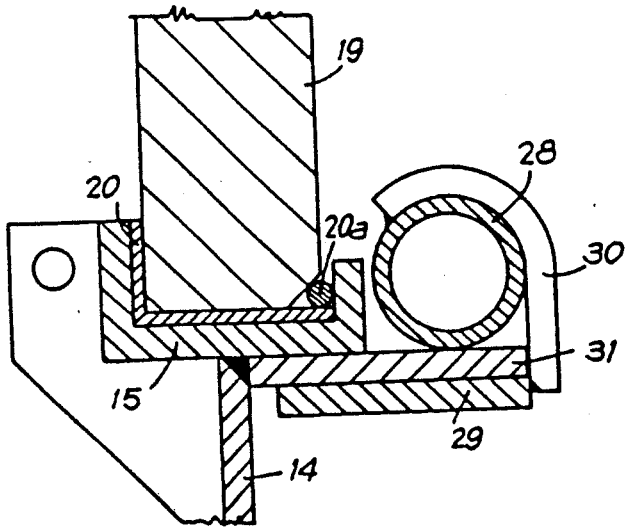
FIG. 6 is a fragmentary vertical section through the bottom link between the capsule and the tubular frame.

FIG. 6 is a fragmentary vertical section on a larger scale going through the resilient link between the pressure-resistant capsule 1 and the tubular frame 2.

This figure shows the bottom edge of the window 19 which is engaged in the bottom flange 15 welded to the top edge of the hemispherical bottom 14, including a flat gasket 20 and an O-ring 20a interposed between the window 19 and the flange 15. With respect to the top edge of window 19, an identical arrangement of gasket 20 and flange 17, with regard to gasket 20 and flange 15, exits.

FIG. 6 also shows a tubular ring 28 which constitutes a portion of the tubular frame 2 and which is disposed coaxially around the flange 15.

A flat metal ring 29 is fixed to the tubular ring 28 by hooks 30. The metal ring 29 carries a flexible flat ring 31 made up of several lengths. The flange 15 rests on the flexible ring 31.

When the vehicle is out of the water, the weight of the pressure-resistant capsule is transmitted via the flange 15, the flat rings 31 and 29, and the hooks 30 to the tubular frame.

Figure 7:
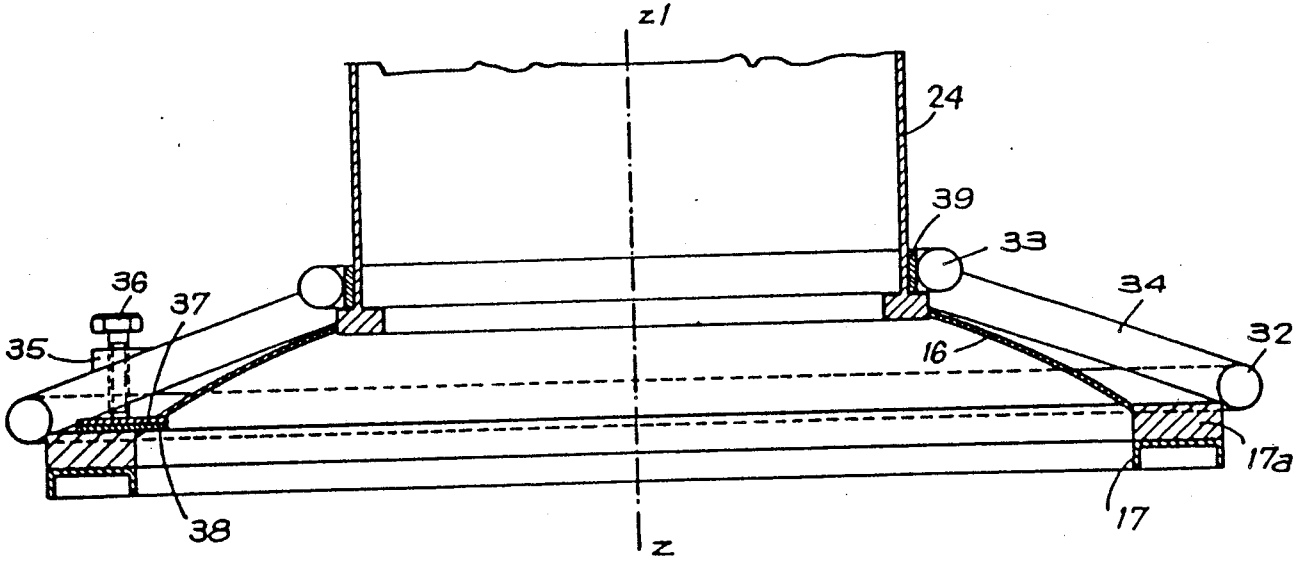
FIG. 7 is a vertical section through the top link between the pressure-resistant capsule and the tubular frame.

When the vehicle is in the water, the pressure-resistant capsule has positive buoyancy and its vertical up thrust is transmitted to the tubular frame via the top flange as shown in FIG. 7, which is a fragmentary axial section showing the flange 17 and a flat reinforcing ring 17a welded to the cap 16. It can be seen in this figure that the tubular frame includes a tubular ring 33 which is connected to the remainder of the frame 32 by sloping spacers 34 having slabs 35 welded thereto, with each slab having a screw 36 screwed therethrough and pressing down on a metal plate 37 which is associated with a resilient plate 38. The up thrust exerted by the pressure-resistant capsule is transmitted to the tubular frame via the reinforcement 17a, the plates 38 and 37, and the screws 36.

The pressure-resistant capsule is centered in the tubular frame by means of a resilient strip 39 which is interposed between the conning tower 24 and the ring 33.

The resilient link between the pressure-resistant capsule and the tubular frame has the effect of preventing any major stress due to differences in buoyancy or to thermal expansion from being transmitted between the capsule and the tubular frame, thus enabling the pressure-resistant capsule to be designed independently taking account solely of the stresses due to hydrostatic pressure. Likewise, since there is no rigid connection between the tubular frame and the capsule, there is no need to fix connection means to the capsule by means of bolts or welding which could reduce its strength.

The mechanical controls leaving the capsule include resilient connections in order to avoid exerting stresses where they pass through the capsule.

In conventional manner, a vehicle in accordance with the invention includes releasable ballast 7 for safety reasons.

In the event of the vehicle coming to rest on the bottom without being able to go back up, small shot or any other divided ballast material contained in a case may be released, with the releasable mass being about 400 kg, thereby ensuring that the buoyancy of the vehicle becomes positive, even if all of its ballast tanks are full of water.

The releasable ballast of a vehicle in accordance with the invention has the peculiar feature of being tiltable by pivoting about a transverse axis, thereby enabling the attitude of the vehicle to be varied and thus increasing the field of view of its occupants.

The lefthand side of FIG. 8 is a front half view and its righthand side is an axial half cross-section through the bottom portion of a vehicle in accordance with the invention.

FIG. 9 is a longitudinal section on IX—IX of FIG. 8 with solid lines showing the releasable ballast in its vertical position and with dashed lines showing the releasable ballast in its forwardly inclined position.

FIGS. 8 and 9 show the bottom flange 15 and the pressure-resistant capsule together with the tubular ring 28 which belongs to the tubular frame.

Two stub axles 40a and 40b are fastened to the ring and are in alignment in order to define a transverse axis y–y1 lying in the axial transverse plane of the pressure-resistant capsule.

The releasable ballast comprises a metal case 41 pivotally mounted about the transverse axis y–y1, at the stub axles 40a and 40b. The case 41 is filled with lead shot or with any other material in the divided state and suitable for constituting releasable ballast. The case 41 is situated between the hemispherical bottom 14 and the case 5 containing the batteries 42.

In section perpendicular to the axis y–y1, the case 41 has an inside wall 41a in the form of a sector of a circle centered on the axis y–y1 and extending over an angle $\alpha$ of about 60°. This inside wall fits generally around the shape of the hemispherical bottom 14 leaving a suitable gap relative thereto so as to allow the case to pivot freely about the axis y–y1 while following the wall of the hemispherical bottom.

The outer wall of the case is constituted by four doors or flaps 43a and 43b which are hinged together in pairs about a transverse axis 44a for the two flaps 43a and about a transverse axis 44b for the two flaps 43b.

The doors 43a and 43b are in the form of portions of cylinders whose generator lines are parallel to the axes 44a and 44b.

The transverse walls of the case 41 include hydraulic actuators 45a and 45b which act as brakes in order to hold the doors 43a and 43b closed.

When it is desired to release ballast, conventional manual valves 51 and electric valves 52 placed inside the cabin are opened, thereby putting the actuators 45a and 45b into communication with a tank 50.

The liquid contained in the actuators 45a and 45b empties out therefrom allowing the doors 43a and 43b to open and the lead shot contained in the cases to be released.

A vehicle in accordance with the invention must not dive below a given depth.

To this end, it is fitted with a sensor 53, e.g. a hydrostatic pressure sensor which emits a signal when a first determined depth of immersion is reached causing an alarm to operate inside the cabin. If the depth continues to increase, a second signal is emitted which automatically causes an electrically-operated valve 52 to open, thereby allowing the actuators 45*a* and 45*b* to empty and thus releasing the ballast so that the vehicle rises to the surface. The hydraulic circuit between the valves, actuators and the tank is of any known conventional type.

The case 41 can be oriented by being pivoted about the axis y–y1. Pivoting control is provided by means of an endless chain or cog belt 46 shown in dashed lines passing over a return pulley 47 and over a sprocket wheel 47*a* which is mounted on a shaft 48 passing through the metal bottom 14 and provided with a control handle 49 placed inside the capsule. The cabin or belt 46 is fastened to the case 41 which it rotates about the axis y–y1.

When the case 41 is inclined, the center of gravity of the vehicle is displaced from vertically below the center of buoyancy and a couple is exerted on the capsule 1 causing it to tilt about the axis y–y1 and thereby enabling the attitude of the capsule to be adjusted over a range of about ±30°.

FIGS. 10 to 17 are diagrams in which shading is used for the contents of the ballast tanks 3, the adjustment ballast tank 8, and for the propulsion units 4 during various operating stages.

Figures 10, 11, 12, 13, 14, 15, 16, 17:
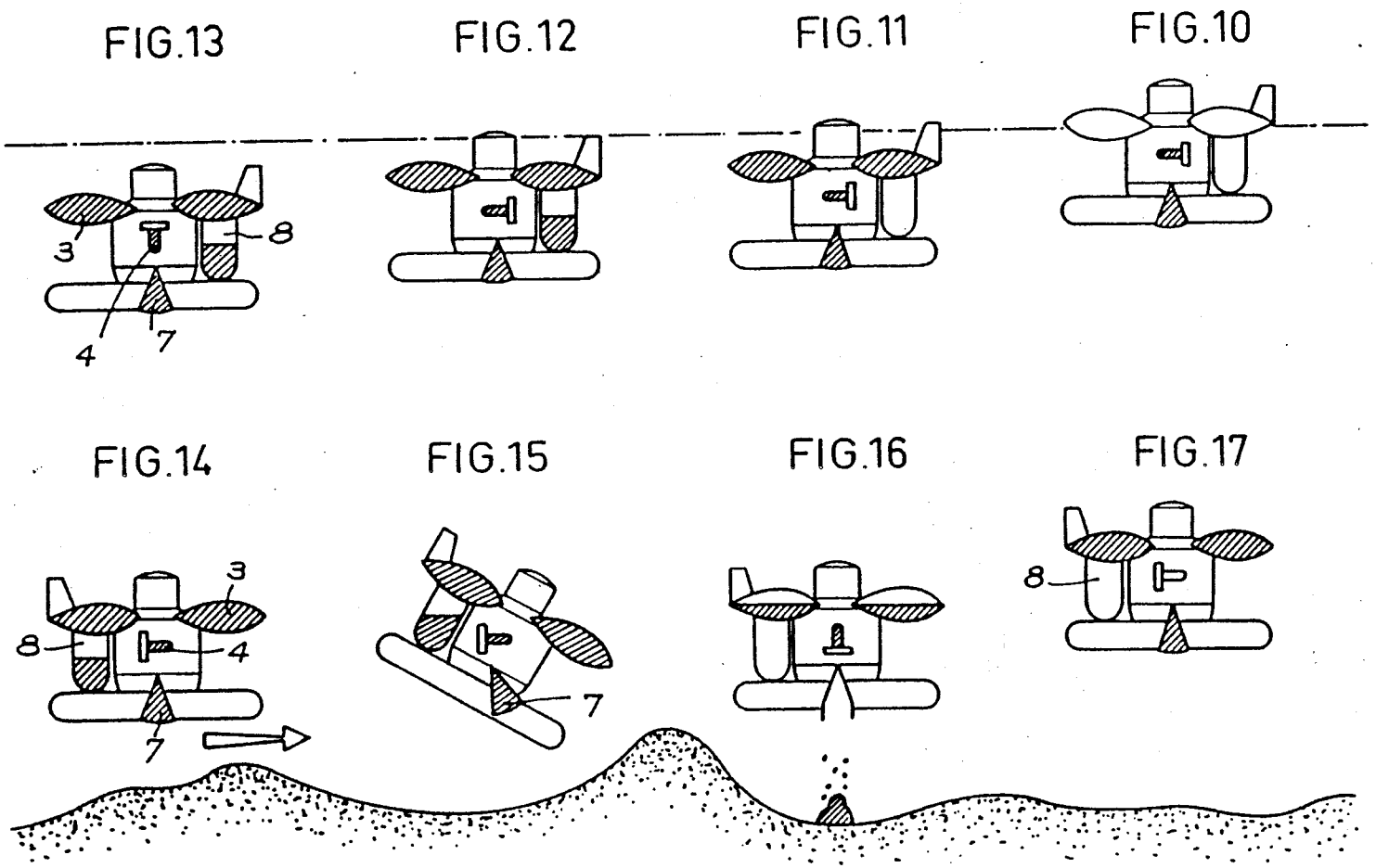
FIGS. 10 to 17 are diagrams showing a vehicle in accordance with the invention at different stages in use.

FIG. 10 shows the vehicle on the surface. Its line of floatation passes slightly beneath the horizontal plane of symmetry of the floats.

FIG. 11 shows an intermediate phase during which the ballast tanks 3 are filled and prior to beginning to fill the adjustment ballast tank 8.

FIG. 12 shows a buoyancy adjustment stage. The ballast tanks 3 are completely full. The adjustment ballast tank 8 is being filled.

FIG. 13 shows a stage of dynamic immersion. The adjustment ballast tank 8 is partially full to the point where the apparent weight of the vehicle is substantially nil. The propulsion units 4 are oriented vertically with their propellers at the top. They therefore drive the vehicle down.

FIG. 14 shows the vehicle during a dive while moving forwardly with the propulsion units 4 being disposed horizontally with their propellers facing aft.

FIG. 15 shows a diving stage during which the occupants are causing the attitude of the vehicle to vary by pivoting the ballast 7 in order to observe the bottom substantially vertically below the vehicle.

FIG. 16 shows a rapid rise stage in an emergency. The doors of the case containing the ballast 7 are open and the ballast has been released. The adjustment ballast tank 8 is emptied. The ballast tanks 3 may also be partially or completely emptied in order to accelerate ascent. The propulsion units 4 are disposed vertically to provide up thrust.

FIG. 17 shows a normal ascent stage. The water contained in the buoyancy adjustment tank 8 is expelled therefrom and this suffices to ensure that buoyancy becomes positive.

I claim:

1. A self-propelled manned submersible vehicle of the type comprising a pressure-resistant capsule serving as a cabin, ballast tanks, releasable ballast, propulsion units having propellers driven by electric motors, and storage batteries, wherein said pressure-resistant capsule comprises a peripheral window constituted by a vertical cylindrical sleeve which is entirely transparent, said sleeve being of sufficient diameter to house a plurality of people sitting side-by-side, said sleeve extending upwardly from a hemispherical bottom and downwardly from a spherical cap which is extended by a cylindrical conning tower which is closed by a hatch.

2. A vehicle according to claim 1, wherein said conning tower includes a second peripheral window constituted by a second vertical cylindrical sleeve which is entirely transparent, and said hatch includes a central transparent porthole.

3. A vehicle according to claim 1, wherein the peripheral window is constituted by a one-piece sleeve of polymethylmethacrylate with the two ends of the sleeve being pressed against gaskets and received in a respective channel section of a top and bottom flange, with said flanges being clamped against said sleeve by tie bars and the top flange connected to the spherical cap and the bottom flange connected to the hemispherical bottom.

4. A vehicle according to claim 3, including a tubular frame surrounding said pressure-resistant capsule and supporting all of the other components of the vehicle, with said pressure-resistant capsule being connected to said tubular frame via resilient connections.

5. A vehicle according to claim 4, wherein said tubular frame includes a first tubular ring which is placed coaxially around the bottom flange and a second tubular ring connected to the frame by spacers and disposed around said spherical cap carrying the top flange, with the bottom flange bearing against a flexible flat ring which is carried by a ridge flat ring hooked to said first tubular ring, and with screws which are screwed to said spacers pressing flexible buffers against said top flange.

6. A vehicle according to claim 1, including ballast tanks which are fixed to the top portion of said tubular frame and which are pod-shaped, being symmetrical about a longitudinal vertical plane with sections in longitudinal vertical planes being rounded at the forward end and tapering at the after end, and also being symmetrical about a horizontal plane with horizontal sections which are tapering at the forward end and which are rounded at the after end.

7. A vehicle according to claim 1, wherein said releasable ballast is constituted by a tiltable case filled with material in the divided state, said case being tiltable about a transverse axis supported by said tubular frame, and said vehicle includes means for controlling the pivoting of said case about said axis from inside the pressure-resistant capsule.

8. A vehicle according to claim 7, wherein said case is received between said hemispherical bottom and a case containing the batteries.

9. A vehicle according to claim 7, wherein said case is closed by doors which open downwardly and which are maintained in the closed position by hydraulic actuators, with the hydraulic circuit feeding said actuators including manually operable valves inside said watertight capsule and electrically-operated valves which are automatically controlled by a pressure sensor for the purpose of releasing said ballast by opening said doors.

10. A vehicle according to claim 1, wherein said tubular frame carries two propulsion units having propellers, said units being tiltable through ±90° about a transverse horizontal axis passing through the center of buoyancy of the pressure-resistant capsule.

* * * * *